US011839901B2

(12) United States Patent
Futterer et al.

(10) Patent No.: US 11,839,901 B2
(45) Date of Patent: Dec. 12, 2023

(54) SCREENING CYLINDER

(71) Applicant: Voith Patent GmbH, Heidenheim (DE)

(72) Inventors: Jürgen Futterer, Horgenzell (DE); Gert Gottschalk, Ravensburg (DE); Roberto Masala, Nattheim (DE); Klaus-Herbert Wiese, Heidenheim (DE); Oliver Zavornik, Giengen (DE); Ivica Zavornik, Giengen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/718,848

(22) Filed: Apr. 12, 2022

(65) Prior Publication Data

US 2022/0234076 A1 Jul. 28, 2022

Related U.S. Application Data

(63) Continuation of application No. PCT/EP2020/077554, filed on Oct. 1, 2020.

(30) Foreign Application Priority Data

Oct. 25, 2019 (DE) ..... 10 2019 128 878.9

(51) Int. Cl.
*B07B 1/12* (2006.01)
*B07B 1/18* (2006.01)
*B07B 1/46* (2006.01)

(52) U.S. Cl.
CPC ..... *B07B 1/12* (2013.01); *B07B 1/18* (2013.01); *B07B 1/4618* (2013.01)

(58) Field of Classification Search
CPC ..... B07B 1/12; B07B 1/18; B07B 1/46189; B07B 1/4618
See application file for complete search history.

(56) References Cited

U.S. PATENT DOCUMENTS 4,846,971 A 7/1989 Lamort
5,791,495 A * 8/1998 Gero ..... B01D 29/23 210/485

(Continued)

FOREIGN PATENT DOCUMENTS

DE 100 65 930 A1 7/2002
DE 10 2006 007 600 A1 8/2007
EP 3 143 198 B1 6/2018

OTHER PUBLICATIONS

Notification of the Transmission of the International Search Report and Written Opinion of the International Search Authority or Declaration dated Jan. 18, 2021 for International Application No. PCT/EP2020/077554 (15 pages).

*Primary Examiner* — Patrick H MacKey
(74) *Attorney, Agent, or Firm* — Taylor IP, P.C.

(57) ABSTRACT

A cylindrical screening device including a plurality of profile bars, in which a number of ring shaped bar holders are arranged perpendicular to a cylinder axis and spaced apart from one another, or bundles of a number of bar holders spaced apart from one another are provided on the inside or the outside with open-edged recesses. The shape of the recesses correspond in a substantially complementary manner to that of the feet of the profile bars. The profile bars are inserted into the recesses, parallel to one another and parallel to the cylinder axis, wherein an outer bar holder is in each case arranged in the region of a respective face-side end ring of the screening device. The attachment of the end ring is simplified in that the outer bar holder is detachably connected with the end ring.

12 Claims, 1 Drawing Sheet

(56) References Cited

U.S. PATENT DOCUMENTS

| | | | | |
|---|---|---|---|---|
| 5,968,357 | A | 10/1999 | Doelle et al. | |
| 6,051,103 | A * | 4/2000 | Aikawa | D21D 5/16 162/251 |
| 6,491,168 | B1 * | 12/2002 | Lutz | B01D 29/445 210/402 |
| 11,273,466 | B2 * | 3/2022 | Brettschneider | B07B 1/4618 |
| 2011/0005981 | A1 * | 1/2011 | Hetu | B07B 1/4627 29/521 |

* cited by examiner

SCREENING CYLINDER

CROSS REFERENCE TO RELATED APPLICATIONS

This is a continuation of PCT application No. PCT/EP2020/077554, entitled "SCREENING CYLINDER", filed Oct. 1, 2020, which is incorporated herein by reference.

BACKGROUND OF THE INVENTION

1. Field of the Invention

The present invention relates to a cylindrical screening device having a plurality of profile bars.

2. Description of the Related Art

A known example for the use of cylindrical screening devices of this type is the screening of fibrous suspensions, as is carried out in pressure screens in the paper making industry. The fibers contained in a suspension are intended to pass through the screen, while the unwanted solid components are rejected at the gap and are directed out of the screening device.

Due to the fact that the openings have an essentially elongated shape, in other words, that they are slots or gaps, fibrous particles can more easily pass through than cuboid ones, even if both types are of a similar size. With this type of screening technology, a very good separation results and can thus be achieved in respect to non-fibrous impurities from the fibrous suspensions.

An application for the separation of different fiber components, the so-called fiber fractionation, is also conceivable. However, the prerequisite is a high precision of the slot shape across the entire screen surface.

One possible method for producing such screen baskets is shown in DE 10 2006 007 660 A1, in which the profile bars are clamped by plastic deformation of the c-shaped retaining rings which are provided with recesses for the bars. Particularly suitable profile bars are used herein for such manufacturing processes. With the help of this process, it was possible to make the production significantly cheaper. The method is used for screen baskets in which the bars are inserted at the inner edge of the retaining rings. Such an arrangement of the bars is selected when the suspension is to pass through the slots from the inside to the outside (in a centrifugal mode of operation). For the reshaping of the retaining rings, bending forces are introduced at the butt ends from the outside, wherein the butt ends support themselves on the inside on support rollers.

In EP 31 43 198 A1 a screening device is described, in which the retaining rings are each formed by a bar holder bundle consisting of several bar holders. When bending the bar holder bundles into rings, the profile bars are clamped in the recesses due to the different position of the neutral fiber of the bar holders of a bar holder bundle.

It is important that the dimensions of the screen openings are adhered to with very small tolerances. In order to keep them free of blockages, scrapers are usually required, which are moved over the screen surface at a short distance, and which generate hydraulic impulses. Screening devices for use in pressure screens must therefore be manufactured with high precision and must withstand high loads.

An additional problem with the previously known screening devices arises in connection with the connectivity of the end rings of the screening devices or respectively screen baskets, regardless of whether the profile bars are welded to the bar holders or not. Thus, the main load during operation of the sorter takes effect most strongly in the region of the welded seam of the end ring since this is the force deflection point with the highest stress load. This also represents a permanent weak point, which repeatedly leads to the end rings breaking off from the screen cylinders at this point. The reason for this is also due to the welding process.

Moreover, strong shrinkage stresses must be countered when welding on the end rings. The screen slots in the immediate vicinity of the welded seam distort. Annealing colors have to be sanded off at great expense.

What is need in the art is a less expensive, simpler way of attaching the end rings to the assembly.

SUMMARY OF THE INVENTION

It is an objective of the current invention to simplify the attachment of the end rings.

According to the present invention the objective is met in that at least the respective outer bar holder is detachably connected with the end ring. This eliminates the need to weld on the end rings, which is particularly problematic with regard to additional stresses. Moreover, this provides the option to reuse the end rings.

The present invention may also be used for screening devices with bar holding bundles, wherein at least the outer bar holder, several or all bar holders of the bar holder bundle are detachably connected with the end ring. The detachable connection is especially easy if it is designed as a screw connection.

In order to prevent an axial displacement of the profile bars in the recesses of the bar holders, one or more profile bars are profiled on the radial outer or inner circumference in the region of the respective end ring and the contact region of the end ring facing the profile are designed complementary to this.

Alternatively or in addition, it may be advantageous if the respective end ring includes a blocking ring arranged perpendicular to the cylinder axis, one or more profile bars are profiled on the radial outer or inner circumference in the region of the respective blocking ring and the contact area of the blocking ring opposite this profile is complementary to it.

To stabilize the position of the blocking ring, the blocking ring is fixed axially to the end ring or between the end ring and the outer bar holder.

It is simple and effective herein if the blocking ring is designed as a ring shaped wire or as a ring shaped disc.

Regardless of the type of axial position fastening, the profiling of the profile bars are designed in such a way that the axial clearance for axial displacement of the profile bars is limited or non-existent due to the interaction with the opposite, complementary profiling.

This direct or indirect form fit between the profile bars and the respective end ring also increases the axial load capacity of the connection between the end ring and the screening device.

For the assembly of the end ring, but also for placement of the blocking ring in or on the end ring, it can be advantageous if the end ring is a multi-part component.

Securement of the profile bars in the other bar holders can be carried out advantageously in that the bar holders are reshaped by forces acting radially from the outside on the bar holders and/or the profile bars until the permanent form fit of the profile bars in the recesses of these bar holders is achieved.

Since the bar holders are already in the embodiment of a ring, and are often a single-part component, the production is considerably simplified. In addition to a precise cylindrical shape, this results in high accuracy in the recesses and thus also in the screen openings.

In many cases, it may be sufficient if securement of the profile bars in the recesses of the bar holders occurs exclusively by means of clamping. If this is not sufficient, however, the profile bars must be fixed in the recesses of the bar holders by welding, gluing or similar processes.

Below, the invention is explained in more detail with reference to a design example.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
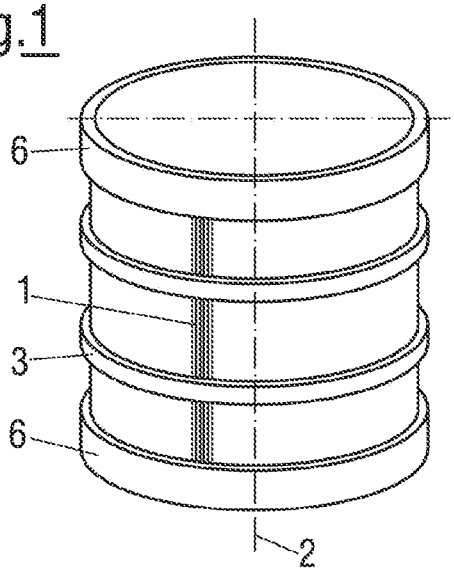
FIG. 1 illustrates a schematic view of an embodiment of a cylindrical screen basket of the present invention.

Referring now to the drawings, bar holders 3.5 are produced as single-component rings, for example by laser cutting. This is the basis for high dimensional accuracy of the screen basket of the present invention.

Figure 2:
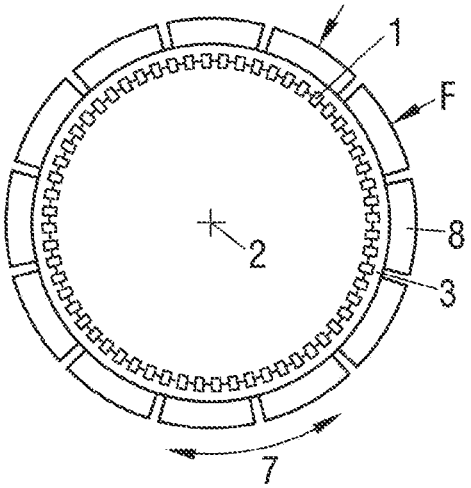
FIG. 2: is a schematic cross-section view through the cylindrical screen basket of FIG. 1.
Figure 3A:
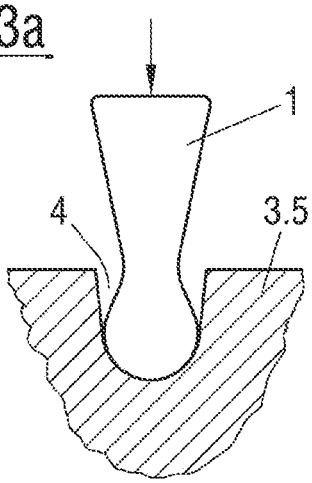
FIG. 3*a*: shows a recess with a profile bar, of the cylindrical screen basket of FIGS. 1 and 2, before radial pressing.

On the inside side, bar holders 3.5—as can be seen in FIGS. 1 and 2—have a multitude of evenly distributed recesses 4 for profile bars 1. According to FIG. 3*a*, these recesses 4 offer sufficient clearance so that profile bars 1 can be easily pushed axially through them.

As a result, the prefabricated screen basket consists of profile bars 1 positioned parallel to cylinder axis 2, profile bars 1 being held in place by several bar holders 3.5 positioned perpendicular to cylinder axis 2.

Figure 4A:
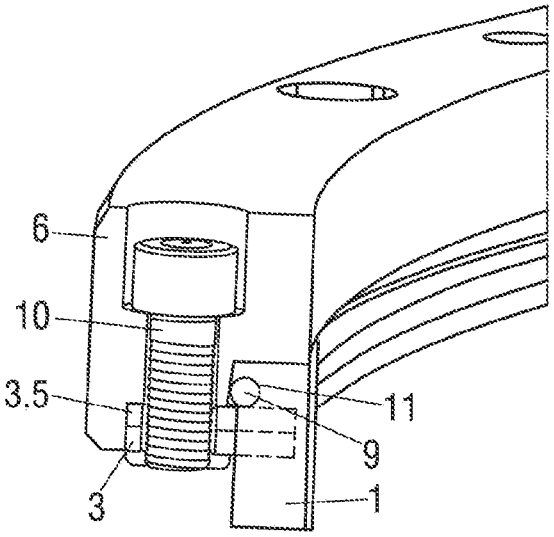
FIG. 4*a*: is a cross-sectional perspective view of the cylindrical screen basket of FIGS. 1 and 2 through an end ring with an outer bar holder and a blocking ring being illustrated.
Figure 4B:
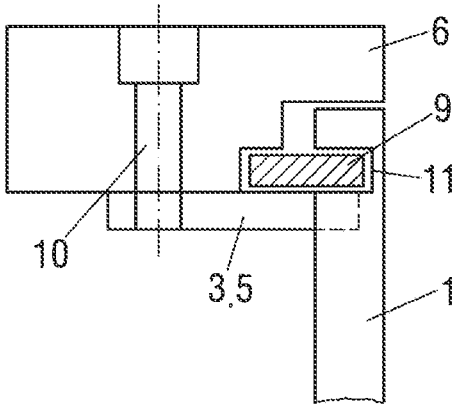
FIG. 4*b*: is a cross-sectional schematic view of the cylindrical screen basket of FIGS. 1, 2 and 4*a* through the end ring with the outer bar holder and a blocking ring being illustrated.

While FIG. 4*b* exemplifies several bar holders 3.5, which are axially spaced at a distance from one another, FIG. 4*a* shows an example of several bundles which consist of two bar holders 3.5 each and which are axially spaced at a distance from one another.

The screen openings of the screen basket are formed by the slots of adjacent profile bars 1. In practice, such slots often have a width of between 0.05 and 2 mm.

For stronger clamping of profile bars 1 in recesses 4, a permanent form fit between profile bars 1 and recesses 4 is created via radial forces F acting from the outside.

According to FIG. 2, the radial force is realized by way of several dies 8 that are evenly distributed radially over the cylinder circumference, and which act radially from the outside directly onto bar holders 3.5, and are therein directed, in particular, onto cylinder axis 2 of the pre-assembled screen basket. The axially arranged dies 8 of adjacent bar holders 3 which are arranged axially next to one another can also be designed as a common die 8.

In this case, the pressing surface of all dies 8, facing in the pressing direction, are formed by a circular section whose radius corresponds to the outer radius of the screening device after the pressing process. Since the outer radius of the screening device, formed by bar holders 3, is slightly larger before the pressing process than afterwards, there is a small clearance between bar holders 3 and the pressing surface in the center part of die 8 at the beginning of the pressing process. This clearance is acceptable at the beginning of pressing and the therewith associated lower pressing forces and decreases with progressive pressing.

Reshaping occurs in a gentle and uniform manner, so that there is no excessive strain on bar holders 3.5. Additional attachment of profile bars 1 can usually be dispensed with.

During the influence of the radial force, dies 8 are guided axially and radially in guide grooves.

Figure 3B:
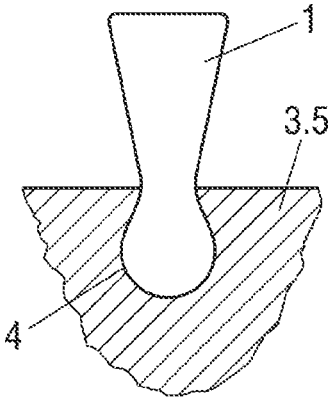
FIG. 3*b*: illustrates the profile bar of FIG. 3*a* after radial pressing.

Since the inside of bar holders 3.5 is not exposed to any supporting or bending forces during the radial force application, the radial force effect leads to a reduction in the diameter of force-actuated bar holders 3.5 and a plastic deformation of bar holders 3.5 in the region of recesses 4, as a result of which the area between profile bar 1 and bar holders 3.5, as shown in FIG. 3*b*, is being closed.

Due to the profiling of profile bars 1, as well as the complementary shape of recesses 4, strong clamping of the bar feet is achieved in respective recess 4.

On each of the two face ends of the screening device an end ring 6 is arranged, adjacent to an outer bar holder 5.

In FIG. 4*b* end rings 6 are each detachably connected by way of a screw connection 10 with axially outer bar holder 5 and in FIG. 4*a* they are each detachably connected by screw connection 10 with the axially outer bundle including outer bar holder 5 and an adjacent axially inner bar holder 3. This screw connection 10 is made by several screws evenly distributed over the circumference of end ring 6 and is highly reliable, which allows, for example, the raising of the screening device above end ring 6.

Welding and corresponding post-processing can be omitted. In addition, reusing end rings 6 after the screening device is worn out is possible.

In order to prevent profile bars 1 in the screening device from shifting axially, respective end ring 6 has a blocking ring 9 arranged perpendicular to cylinder axis 2.

In FIG. 4*a* blocking ring 9 is shown in the embodiment of a ring shaped wire with a circular cross-section and in FIG. 4*b* as a ring shaped disc. Securement of the axial position of blocking ring 9 is implemented in both cases by clamping a radial outer section of blocking ring 9 between end ring 6 and adjacent outer bar holder 5.

For the axial position securement of profile bars 1, the latter are profiled herein at the radial outer circumference in the region of respective blocking ring 9, wherein the contact area of blocking ring 9 opposite this profile 11 is complementary to it.

Profile 11 is designed in such a way that, in conjunction with the complementary contact area, a relative shift between profile bar 1 and blocking ring 9 is prevented. As a result, blocking ring 9, which is fixed axially to end ring 6, protrudes in both designs radially into profile bar 1.

Other possibilities of axial position securement or design of blocking ring 9 or profiling arise if end ring 6 is designed as a multi-part component.

Sectioning of end ring 6 is possible in radial, axial or circumferential direction.

The detachable attachment of end rings 6 to outer bar holder 5 or to the outer bar holder bundle can be carried out regardless of whether bar holders 5 have their recesses 4 as shown here on the inside or on the outside. This also applies regardless of the method of attachment of profile bars 1 to rod holders 3.5.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cylindrical screening device comprising:

a plurality of profile bars, each bar having a foot;

a plurality of annular bar holders arranged perpendicular to a cylinder axis and are spaced apart from one another are provided on the inside or the outside of the annual bar holders with open-edged recesses, the shape of the open-edged recesses corresponding in a substantially complementary manner to that of the feet of the profile bars, and wherein the profile bars are inserted into the recesses parallel to one another and parallel to the cylinder axis;

a face-side end ring; and an outer bar holder arranged in a region of the face-side end ring of the screening device, the outer bar holder being detachably connected with the face-side end ring, the end ring including a blocking ring, the blocking ring protruding into a profile of the profile bars.

2. The cylindrical screening device according to claim 1, wherein the outer bar holder is part of a bundle consisting of several bar holders.

3. The cylindrical screening device according to claim 2, wherein at least some of the bar holders of the bar holder bundle are detachably connected with the end ring.

4. The cylindrical screening device according to claim 3, wherein the detachable connection is a screw connection.

5. The cylindrical screening device according to claim 1, wherein one or more of the profile bars are profiled on the radial outer or inner circumference in the region of the end ring and a contact area of the end ring opposite of the profile is shaped complementary to it.

6. The cylindrical screening device according to claim 1 wherein the blocking ring is arranged perpendicular to the cylinder axis; and at least one of the profile bars are profiled on the radial outer or inner circumference in the region of the blocking ring, and a contact area of the blocking ring opposite the profile complementary to it.

7. The cylindrical screening device according to claim 6, wherein the blocking ring is fixed axially to the end ring or between the end ring and the outer bar holder.

8. The cylindrical screening device according to claim 6, wherein the blocking ring is a ring shaped wire or a ring shaped disc.

9. The cylindrical screening device according to claim 1, wherein the end ring is a multi-part component.

10. A cylindrical screening device comprising:

a plurality of profile bars, each bar having a foot;

bundles of a number of bar holders spaced apart from one another are provided on the inside or the outside of the annual bar holders with open-edged recesses, the shape of the open-edged recesses corresponding in a substantially complementary manner to that of the feet of the profile bars, and wherein the profile bars are inserted into the recesses parallel to one another and parallel to a cylinder axis;

a face-side end ring; and an outer bar holder arranged in a region of the face-side end ring of the screening device, the outer bar holder being detachably connected with the end ring, the end ring including a blocking ring, the blocking ring protruding into a profile of the profile bars.

11. The cylindrical screening device according to claim 1, wherein the blocking ring clamps against the profile of the profile bar thereby holding the profile bars against the end ring.

12. The cylindrical screening device according to claim 11, wherein the blocking ring clamps against the profile of the profile bar thereby holding the profile bars against the end ring.

* * * * *